US007497204B2

(12) United States Patent
Perryman et al.

(10) Patent No.: US 7,497,204 B2
(45) Date of Patent: Mar. 3, 2009

(54) DRIVE CIRCUIT FOR AN INJECTOR ARRANGEMENT AND A DIAGNOSTIC METHOD

(75) Inventors: Louisa J Perryman, Rainham (GB); Martin A P Sykes, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 8 days.

(21) Appl. No.: 11/804,839

(22) Filed: May 21, 2007

(65) Prior Publication Data

US 2008/0006246 A1 Jan. 10, 2008

(30) Foreign Application Priority Data

May 23, 2006 (GB) ..... 0610226.3
Jul. 11, 2006 (EP) ..... 06253619

(51) Int. Cl.
*F02M 51/00* (2006.01)

(52) U.S. Cl. ..... 123/479; 123/490; 73/114.45; 701/114

(58) Field of Classification Search ..... 123/478, 123/479, 480, 486, 490, 491; 701/114, 115; 73/114.45, 114.58; 361/152
See application file for complete search history.

(56) References Cited

U.S. PATENT DOCUMENTS 6,360,161 B1 * 3/2002 Francis et al. ..... 701/115
6,671,611 B1 * 12/2003 Peltier ..... 701/104
6,761,059 B2 * 7/2004 Hsia et al. ..... 73/114.45
6,879,903 B2 * 4/2005 Jaliwala et al. ..... 701/104
7,113,862 B2 * 9/2006 Radue ..... 701/103
7,124,741 B2 * 10/2006 Cagnoni et al. ..... 123/472
7,136,743 B2 * 11/2006 Peltier ..... 701/115
7,164,984 B2 * 1/2007 Radue ..... 701/115
7,252,072 B2 * 8/2007 Slater et al. ..... 123/479
7,273,039 B2 * 9/2007 Ohno et al. ..... 123/479
7,302,337 B2 * 11/2007 Jargenstedt ..... 701/114
2007/0227506 A1 * 10/2007 Perryman et al. ..... 123/479

FOREIGN PATENT DOCUMENTS

| | | |
|---|---|---|
| DE | 10323491 | 12/2004 |
| DE | 102004021377 | 11/2005 |
| EP | 1139442 | 1/2000 |
| EP | 1400677 | 3/2004 |
| WO | WO 2004/051066 | 6/2004 |
| WO | 2005/028836 | 3/2005 |

* cited by examiner

*Primary Examiner*—Willis R. Wolfe, Jr.
*Assistant Examiner*—Johnny H. Hoang
(74) *Attorney, Agent, or Firm*—Thomas N. Twomey

(57) ABSTRACT

The invention relates to a drive circuit for an injector arrangement comprising a first fuel injector in parallel with a capacitive component. The drive circuit comprises: a selector means ($SQ_1$, $SQ_2$) and diagnostic means. The selector means ($SQ_1$, $SQ_2$) is operable to select the first fuel injector and/or the capacitive component into the drive circuit and to deselect the first fuel injector and/or the capacitive component from the drive circuit. When the capacitive component is selected and the first fuel injector is deselected, the diagnostic means is operable to sense a current ($I_{sense}$) through the first fuel injector. When the sensed current ($I_{sense}$) is at variance from a first threshold current ($I_{limit}$) the diagnostic means is operable to provide a first signal on detection of a stack terminal short circuit fault associated with the first fuel injector. The capacitive component may be a second fuel injector.

14 Claims, 5 Drawing Sheets

DRIVE CIRCUIT FOR AN INJECTOR ARRANGEMENT AND A DIAGNOSTIC METHOD

TECHNICAL FIELD

The present invention relates to a drive circuit for an injector arrangement having a diagnostic means for detecting a fault, and to a diagnostic method for the drive circuit of an injector arrangement. The drive circuit is especially, although not exclusively, for an injector arrangement in an internal combustion engine, the injector arrangement including an injector of the type having a piezoelectric actuator for controlling injector valve needle movement.

BACKGROUND ART

Automotive vehicle engines are generally equipped with fuel injectors for injecting fuel (e.g., gasoline or diesel fuel) into the individual cylinders or intake manifold of the engine. The engine fuel injectors are coupled to a fuel rail which contains high pressure fuel that is delivered by way of a fuel delivery system. In diesel engines, conventional fuel injectors typically employ a valve needle that is actuated to open and to close in order to control the amount of fluid fuel metered from the fuel rail and injected into the corresponding engine cylinder or intake manifold.

One type of fuel injector that offers precise metering of fuel is the piezoelectric fuel injector. Piezoelectric fuel injectors employ piezoelectric actuators made of a stack of piezoelectric elements arranged mechanically in series for opening and for closing an injection valve needle to meter fuel injected into the engine. Piezoelectric fuel injectors are well known for use in automotive engines.

The metering of fuel with a piezoelectric fuel injector is generally achieved by controlling the electrical voltage potential applied to the piezoelectric elements to vary the amount of expansion and contraction of the piezoelectric elements. The amount of expansion and contraction of the piezoelectric elements varies the travel distance of a valve needle and, thus, the amount of fuel that is passed through the fuel injector. Piezoelectric fuel injectors offer the ability to meter precisely a small amount of fuel.

Typically, the fuel injectors are grouped together in banks of one or more injectors. As described in EP1400676, each bank of injectors has its own drive circuit for controlling operation of the injectors. The circuitry includes a power supply, such as a transformer, which steps-up the voltage $V_S$ generated by a power source, i.e. from 12 Volts to a higher voltage, and storage capacitors for storing charge and, thus, energy. The higher voltage is applied across the storage capacitors which are used to power the charging and discharging of the piezoelectric fuel injectors for each injection event. Drive circuits have also been developed, as described in WO 2005/028836A1, which do not require a dedicated power supply, such as a transformer.

The use of these drive circuits enables the voltage applied across the storage capacitors, and thus the piezoelectric fuel injectors, to be controlled dynamically. This is achieved by using two storage capacitors which are alternately connected to an injector arrangement. One of the storage capacitors is connected to the injector arrangement during a discharge phase when a discharge current flows through the injector arrangement, initiating an injection event. The other storage capacitor is connected to the injector arrangement during a charging phase, terminating the injection event. A regeneration switch is used at the end of the charging phase, before a later discharge phase, to replenish the storage capacitors.

Like any circuit, faults may occur in a drive circuit. In safety critical systems, such as diesel engine fuel injection systems, a fault in the drive circuit may lead to a failure of the injection system, which could consequentially result in a catastrophic failure of the engine. A robust diagnostic system is therefore required to detect critical failure modes of piezoelectric actuators, and of the associated drive circuits, particularly whilst the drive circuit is in use.

An aim of the invention is therefore to provide a diagnostic tool that is capable of detecting critical failure modes, or fault response characteristics, of an injector arrangement, and the associated drive circuit, and a method of operating the diagnostic tool.

SUMMARY OF THE INVENTION

According to a first aspect of the invention there is provided a drive circuit for an injector arrangement comprising a first fuel injector in parallel with a capacitive component. The drive circuit comprises selector means and diagnostic means. The selector means is operable to select the first fuel injector and/or the capacitive component into the drive circuit and to deselect the first fuel injector and/or the capacitive component from the drive circuit. When the capacitive component is selected and the first fuel injector is deselected, the diagnostic means is operable to sense a current through the first fuel injector. Then, when the sensed current is at variance from a first threshold current indicative of a short circuit fault associated with first fuel injector, the diagnostic means is operable to provide a first signal. The first fuel injector and the capacitive component may have substantially the same capacitance.

A fuel injector comprises an actuator that has capacitive properties. So, when a fuel injector with a charged actuator is deselected, the fuel injector should not conduct current. However, if the fuel injector has a short circuit fault between terminals of the actuator (termed a "stack terminal short circuit fault") the fuel injector conducts to discharge. In one form of injector arrangement having a single selectable fuel injector, the fuel injector is in parallel with a capacitive component so that the fuel injector can be deselected from the drive circuit associated with the injector arrangement, and the electrical element can be selected. When the actuator of the deselected fuel injector is fully charged it should not draw current. However, if the deselected fuel injector has a stack terminal short circuit fault, it draws current away from the selected capacitive component. So, advantageously, by sensing the current flowing through the deselected fuel injector, it is possible to determine whether or not the deselected injector has a stack terminal short circuit fault. When the first signal is provided by the diagnostic means, an indication of the stack terminal short circuit fault is provided.

When the capacitive component is deselected and the first fuel injector is selected, the diagnostic means may be operable to sense the sensed current through the capacitive component.

In one embodiment, the capacitive component may be a second fuel injector. Each of the first and second injectors may be arranged in series with an associated current sensor. So, both the first and second fuel injectors may be deselected and tested in turn for stack terminal faults, and a stack terminal short circuit fault can be associated with a particular fuel injector of the injector arrangement. This is beneficial because during normal running conditions, each of the fuel injectors may be selected in turn for injection, whilst the other fuel injectors are deselected.

The drive circuit may comprise first charge storage means and second storage means. The first charge storage means may be for operative connection with a selected one of the first fuel injector and the second fuel injector during a charging phase so as to cause a charge current to flow therethrough. The second charge storage means may be for operative connection with the selected one of the first fuel injector and the second fuel injector during a discharge phase so as to permit a discharge current to flow therethrough. The drive circuit may comprise switch means for operably controlling the connection of the selected one of the first fuel injector and the second fuel injector to the first charge storage means or the second charge storage means. Advantageously, the discharge phase may initiate an injection event, and the charging phase may terminate the injection event. In an alternative embodiment, the charging phase initiates an injection event and the discharge phase terminates the injection event.

Since the switch means may be actuated when either the first fuel injector or the second fuel injector is selected, the diagnostic means can be operable to sense an open sensed current through the selected one of the fuel injector and the second fuel injector. When the diagnostic means senses that the open sensed current is substantially equal to the first threshold current, the diagnostic means may provide a second signal which is indicative of an open circuit fault. This embodiment is beneficial, because it is possible to associate a detected open circuit fault with a particular fuel injector of the injector arrangement.

The switch means may comprise a charge switch operable to close so as to activate the charging phase. Advantageously, the charge switch can be operated at start up so that an open circuit fault can be detected. A discharge switch may be operable to close so as to activate the discharge phase, permitting an open circuit fault to be detected during normal running conditions.

Thus, the diagnostic means is beneficially enabled to sense the sensed current for an open circuit fault associated with the first fuel injector on operation of both the selector means to select the first fuel injector and the switch means. However, the diagnostic means is enabled to sense stack terminal short circuit faults associated with the first fuel injector on operation of the selector means to deselect the first fuel injector and to select the second fuel injector. The selector means may comprise selector switch means associated with each of the first and second fuel injectors. Advantageously, each of the first fuel injector and the second fuel injector may be connected to and removed from the drive circuit by operation of its associated selector switch means.

The diagnostic means may comprise a current sensor associated with each of the first and second fuel injectors. The current sensors may each be in series with the respective one of the first fuel injector and the second fuel injector. Advantageously, the current sensors permit the current through the first fuel injector and the second fuel injector to be closely monitored.

The first threshold current may be equal to substantially zero amps. This has the benefit that in order to detect a stack terminal short circuit fault, it is not necessary to sense a reference current for comparison with the sensed current.

The sensed current may be at variance from the first threshold current if it differs from the first threshold current by more than a tolerance current. So, in the detection of a stack terminal short circuit fault, errors of current measurement and insignificant stray currents may be accounted for. Beneficially, the diagnostic means provides a signal where the fuel injector is unable to function satisfactorily. Accordingly, the open sensed current may be considered to be substantially the same as the first threshold current if it falls within an open circuit tolerance current either side of the first threshold current. Advantageously, the diagnostic means is thus able to detect an open circuit fault in the injector arrangement, even where there are small systematic errors in measuring the sensed current. Furthermore, the open circuit tolerance is very small.

The diagnostic means may be operable to sense a measured voltage between a bank connection of the first fuel injector to the second fuel injector and a known voltage level. The measured voltage is biased with respect to the known voltage to a predicted voltage, unless the drive circuit has an open or a short circuit fault. The diagnostic means may provide a third signal which is indicative of the fault. The third signal indicative of a fault is beneficially provided on sensing of a measured voltage that differs from the predicted voltage. So, the diagnostic means may additionally use a voltage associated with the first fuel injector in order to detect the fault and to identify its type. The third signal may be provided if the measured voltage is at variance from the predicted voltage by more than a tolerance voltage. So, the diagnostic means provides a third signal only when the fuel injector is unable to function satisfactorily.

The third signal may be indicative of a short circuit fault when the predicted voltage is the voltage difference between the bank connection and the known voltage level and when the first fuel injector and the second fuel injector are deselected from the drive circuit. This provides the benefit that the diagnostic means is capable of detecting a short circuit fault associated with the first fuel injector. Thus, it is possible to detect the short circuit fault without having to select the first fuel injector or the second fuel injector, restricting the damage that may be caused to the fuel injectors and the rest of the drive circuit by the short circuit fault.

The third signal may be indicative of an open circuit fault associated with the injector arrangement when the predicted voltage is substantially the sum of the known voltage and a voltage across the first fuel injector and the second fuel injector, when one of the first fuel injector and the second fuel injector is selected in the drive circuit. Advantageously, the diagnostic means may therefore be capable of detecting an open circuit fault associated with the first fuel injector by sensing a voltage associated with the injector arrangement. In one embodiment, the diagnostic means is capable of detecting both open and short circuit faults, so that the third signal is indicative of both types of fault.

The diagnostic means may be capable of detecting short circuit faults associated with the fuel injector arrangement. In this embodiment, the diagnostic means may be in a ground connection to a ground potential, and may be operable to sense a detected current. The diagnostic means may be operable on sensing of a detected current to provide a fourth signal indicative of a short circuit fault. Typically, the types of short circuit detectable may include short circuits from a high side or a low side of the fuel injector to the ground potential, or a low voltage source such as a battery. The fourth signal may be provided when the detected current is at variance from a second threshold current, and advantageously when the detected current is greater than the second threshold current. So, the diagnostic means uses a current associated with the fuel injector in order to detect a short circuit fault, enabling detection of types of short circuit fault associated with the fuel injector other than a stack terminal fault. The type of short circuit fault may then be determined by assessing the detected and sensed currents.

The ground connection of the drive circuit to the ground potential may be connected to the switch means for operably controlling the connection of the fuel injectors to the first charge storage means or the second charge storage means. Beneficially, the ground connection is connected to one of the two charge storage means and, advantageously, to the discharge switch.

In one embodiment, the drive circuit has a power supply means. In addition, the drive circuit may have a regeneration switch means. The operation of the regeneration switch means may transfer charge from the power supply means to the first charge storage means, before a subsequent discharge phase. Operating the regeneration switch means provides an advantage of enabling detection of a short circuit fault indicated by the fourth signal. The regeneration switch means may be operated prior to the detection of a fault and, advantageously, is operable at the end of the charging phase to transfer charge.

Furthermore, the drive circuit may be integrated within the microcomputer, such as an ECM. In another embodiment, however, the drive circuit is separate from, but connected to, the rest of the ECM.

According to a second aspect of the invention there is an injector bank for an automotive engine. The injector bank comprises a first fuel injector, a capacitive component and a drive circuit according to the first aspect of the invention, so that the fuel injector is operable by the drive circuit. Where the capacitive component is a fuel injector, it may also be operable by the drive circuit.

According to a third aspect of the invention, there is provided an engine control module for controlling the operation of an engine. The engine control module comprises a microprocessor, a memory and a drive circuit according to the first aspect of the invention. The microprocessor controls the operation of the engine via the drive circuit and the memory records data.

According to a fourth aspect of the invention, there is provided a method of detecting stack terminal short circuit faults in a drive circuit for an injector arrangement comprising a first fuel injector and a capacitive component that are arranged in parallel. The method comprises selecting the capacitive component into the drive circuit and deselecting the first fuel injector from the drive circuit. A current is sensed through the first fuel injector. A first signal is provided on detection of a stack terminal short circuit fault associated with the first fuel injector when the sensed current is at variance from a first threshold current.

The method may additionally comprise deselecting the capacitive component and selecting the first fuel injector. In the method, the sensed current may be sensed through the deselected capacitive component. This is beneficial when the capacitive component is a second fuel injector as it permits the selection of the first and second fuel injectors, in turn, in order to detect a stack terminal fault in either one of them.

In one embodiment of the method, selecting the first fuel injector into, and deselecting the first fuel injector from, the drive circuit comprises operating selector switch means. It is beneficial for the selector switch means to be in series with the fuel injector. In a variant of this embodiment of the method, selecting the second fuel injector into, and deselecting the second fuel injector from, the drive circuit comprises operating said selector switch means. The selector switch means may be in series with the second fuel injector.

The method may comprise controlling switch means to operate the connection of one of the first fuel injector and the second fuel injector to first charge storage means or to second charge storage means. The switch means may operate to connect to the first charge storage means during a charging phase so as to cause a charge current to flow therethrough. During a discharge phase the switch means operates to connect to the second charge storage means so as to cause a discharge current to flow therethrough.

When the switch means is operated and one of the first fuel injector and the second fuel injector is selected, the method comprises sensing an open sensed current through the selected one of the first fuel injector and the second fuel injector. Monitoring the sensed current may be by a current sensor associated with the first fuel injector. The current sensor is, advantageously, in series with the first fuel injector. When the open sensed current is substantially the first threshold current, a second signal may be provided on detection of an open circuit fault associated with the selected one of the injectors.

The switch means may comprise a charge switch. Advantageously, the charge switch activates a charging phase by operating the charge switch prior to detection of a fault associated with at least one of the fuel injectors. The charge switch may be activated at start-up in order to detect an open circuit fault. The switch means may include a discharge switch. In one embodiment of the method, the discharge switch is operated to activate the discharge phase prior to detection of a fault associated with one of the fuel injectors. The discharge switch may be operated during normal running conditions to detect an open circuit fault.

A measured voltage may be sensed between a bank connection of the first fuel injector to the capacitive component and a known voltage level. The measured voltage may be biased with respect to the known voltage to a predicted voltage unless the drive circuit has a fault. Beneficially, on sensing a measured voltage that differs from the predicted voltage, the method includes providing a third signal indicative of an open or a short circuit fault.

The method may include sensing a detected current through a ground connection of the drive circuit to the ground potential. When the detected current is at variance from a second threshold current the method may provide a fourth signal indicative a short circuit fault.

According to a fifth aspect of the invention there is provided a computer program product. The computer program product comprises at least one computer program software portion. The at least one computer program, when executed in an executing environment, is operable to implement one or more of the steps of the method of the fourth aspect of the invention.

According to a sixth aspect of the invention there is provided a data storage medium having the or each computer software portion of the fifth aspect of the invention.

According to a seventh aspect of the invention there is provided a microcomputer having the data storage medium according to the sixth aspect of the invention.

In all aspects of the invention, where the first and second fuel injectors are provided they are both advantageously of a negative-charge displacement type. However, positive-charge displacement type actuated fuel injectors may be used, for which charging initiates an injection event and discharging terminates the fuel injection event. For a positive-charge displacement type fuel injector, the methods of using the diagnostic means are the same, except certain features are reversed.

The terms close and activate are interchangeable, when used in connection with a switch, and are intended to include the actuation of any suitable switching means to create an electrical connection across the switch. Conversely, the terms open and deactivate, when used in connection with a switch, are interchangeable, and are intended to include the actuation of any suitable switching means to break an electrical connection across the switch.

DRAWINGS

Various embodiments of the present invention will now be described, by way of example, with reference to the accompanying drawings, in which.

DETAILED DESCRIPTION

Figure 1:
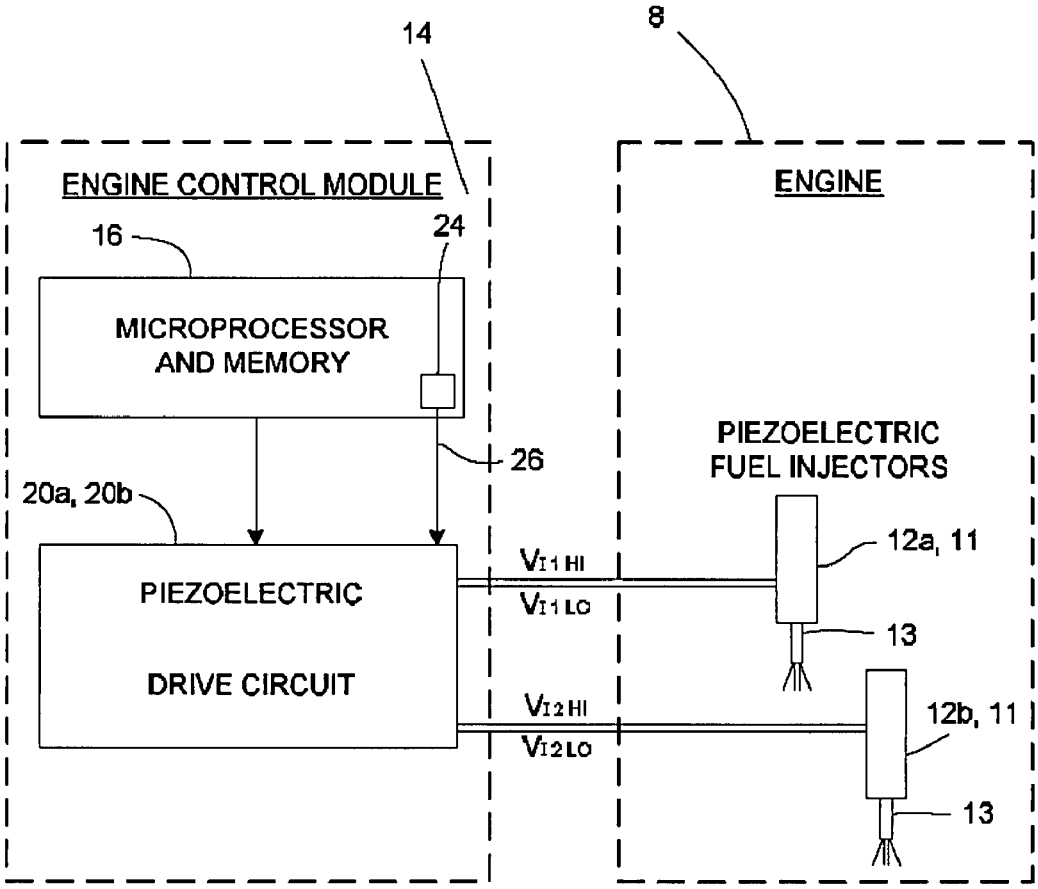
FIG. 1 is a block diagram illustrating a drive circuit for controlling a piezoelectric fuel injector arrangement in an engine.

Referring to FIG. 1, an engine 8, such as an automotive vehicle engine, is generally shown having an injector arrangement comprising a first fuel injector 12*a* and a second fuel injector 12*b*. The fuel injectors 12*a*, 12*b* each have an injector valve needle 13 and a piezoelectric actuator 11. The piezoelectric actuator 11 is operable to cause the injector valve needle 13 to open and close to control the injection of fuel into an associated cylinder of the engine 8. The fuel injectors 12*a*, 12*b* may be employed in a diesel internal combustion engine to inject diesel fuel into the engine 8, or they may be employed in a spark ignited internal combustion engine to inject combustible gasoline into the engine 8.

The fuel injectors 12*a*, 12*b* form a first injector set 10 of fuel injectors of the engine 8 and are controlled by means of a drive circuit 20*a*. The drive circuit 20*a* is arranged to monitor and control the injector high side voltages $V_{I1HI}$, $V_{I2HI}$ and injector low side voltages $V_{I1LO}$, $V_{I2LO}$ so as to control actuation of the first and second fuel injectors 12*a*, 12*b* respectively, to open and close the injectors. Voltages $V_{I1HI}$ and $V_{I2HI}$ represent the high side voltages of the fuel injectors 12*a*, 12*b*, respectively, and $V_{I1LO}$, $V_{I2LO}$ represent the low side voltages of the fuel injectors 12*a*, 12*b*, respectively.

In practice, the engine 8 may be provided with two or more injector sets, each containing one or more fuel injectors and each injector set having its own drive circuit 20*a* to $\mathbf{20}_N$. Where possible, for reasons of clarity, the following description relates to only one of the injector sets. In the embodiments of the invention described below, the fuel injectors 12*a*, 12*b* are of a negative-charge displacement type. The fuel injectors 12*a*, 12*b* are therefore opened to inject fuel into the engine cylinder during a discharge phase and closed to terminate injection of fuel during a charging phase.

The engine 8 is controlled by an Engine Control Module (ECM) 14, of which the drive circuit 20*a* forms an integral part. The ECM 14 includes a microprocessor 16 and a memory 24 which are arranged to perform various routines to control the operation of the engine 8, including the control of the fuel injector arrangement. The ECM 14 is arranged to monitor engine speed and load. It also controls the amount of fuel supplied to the fuel injectors 12*a*, 12*b* and the timing of operation of the fuel injectors. The ECM 14 is connected to an engine battery (not shown) which has battery voltage $V_{BAT}$ of about 12 Volts. The ECM 14 generates the voltages required by other components of the engine 8 from the battery voltage $V_{BAT}$.

Further detail of the operation of the ECM 14 and its functionality in operating the engine 8, particularly the injection cycles of the injector arrangement, is described in detail in WO 2005/028836. Signals are transmitted between the microprocessor 16 and the drive circuit 20*a* and data, comprised in the signals received from the drive circuit 20*a*, is recorded on the memory 24.

The drive circuit 20*a* operates in three main phases: a charging phase, a discharge phase and a regeneration phase. During the discharge phase, the drive circuit 20*a* operates to discharge one of the fuel injectors 12*a*, 12*b* to open the injector valve needle 13 to inject fuel. During the charging phase, the drive circuit 20*a* operates to charge the previously discharged fuel injector 12*a*, 12*b* to close the injector valve needle 13 to terminate injection of fuel. During the regeneration phase, energy in the form of electric charge is replenished to a first storage capacitor $C_1$ and a second storage capacitor $C_2$ (not shown in FIG. 1), for use in subsequent injection cycles, so that a dedicated power supply is not required. Each of these phases of operation will be described in further detail below.

Figure 2:
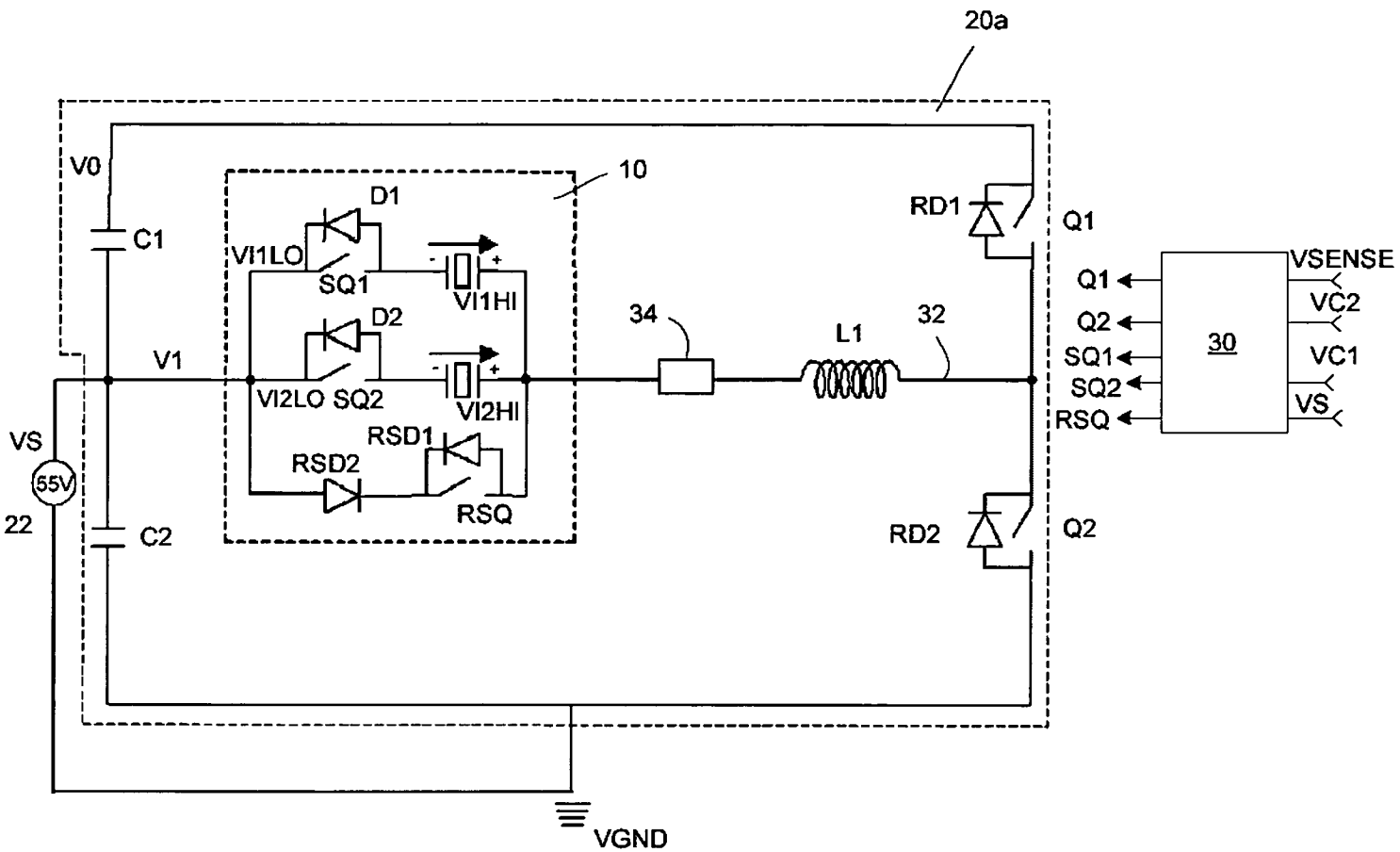
FIG. 2 is a circuit diagram illustrating the drive circuit in FIG. 1.

Referring also to FIG. 2, the drive circuit 20*a* comprises a first voltage rail $V_0$ and a second voltage rail $V_1$. The first voltage rail $V_0$ is at a higher voltage than the second voltage rail $V_1$. The drive circuit 20*a* also includes a half-H-bridge circuit having a middle current path 32 which serves as a bi-directional current path. The middle current path 32 has an inductor $L_1$ coupled in series with the injector set 10 of fuel injectors 12*a*, 12*b*. The fuel injectors 12*a*, 12*b* and their associated switching circuitry are connected in parallel with each other.

Each fuel injector 12*a*, 12*b* has the electrical characteristics of a capacitor, with its piezoelectric actuator 11 being chargeable to hold voltage which is the potential difference between a low side (−) terminal and a high side (+) terminal of the piezoelectric actuator 11.

The drive circuit 20*a* further comprises the first storage capacitor $C_1$ and the second storage capacitor $C_2$. Each of the storage capacitors $C_1$, $C_2$ has a positive and a negative terminal. Each storage capacitor $C_1$, $C_2$ has a high side and a low side; the high side is on the positive terminal of the capacitor and the low side is on the negative terminal. The first storage capacitor $C_1$ is connected between the first voltage rail $V_0$ and the second voltage rail $V_1$. The second storage capacitor $C_2$ is connected between the second voltage rail $V_1$ and the ground potential $V_{GND}$.

In addition, as the drive circuit 20*a* has a voltage source $V_S$, or power supply, 22 supplied by the ECM 14, the drive circuit 20*a* does not have a dedicated power supply. The voltage source $V_S$ is connected between the second voltage rail $V_1$ and the ground potential $V_{GND}$, and is arranged to supply energy to the second storage capacitor $C_2$. Energy is supplied to the first storage capacitor $C_1$ by regeneration of charge to it during the regeneration phase. Typically the voltage source $V_S$ is between 50 and 60 Volts.

In the drive circuit 20*a* there is a charge switch $Q_1$ and a discharge switch $Q_2$ for controlling, respectively, the charging and discharging operations of the first and second fuel injectors 12*a*, 12*b*. The charge and the discharge switches $Q_1$, $Q_2$ are operable by the microprocessor 16. Each of the charge and the discharge switches $Q_1$, $Q_2$, when closed, allows for unidirectional current flow through the respective one of the switches and, when open, prevents current flow. The charge switch $Q_1$ has a first recirculation diode $RD_1$ connected across it. Likewise, the discharge switch $Q_2$ has a second recirculation diode $RD_2$ connected across it. These recirculation diodes $RD_1$, $RD_2$ permit recirculation current to return charge to the first storage capacitor $C_1$ and the second storage capacitor $C_2$, respectively, during an energy recirculation phase of operation of the drive circuit 20*a*, in which energy is recovered from at least one of the fuel injectors 12*a*, 12*b*.

The first fuel injector 12*a* is connected in series with an associated first selector switch $SQ_1$ and the second fuel injector 12*b* is connected in series with an associated second selector switch $SQ_2$. Each of the selector switches $SQ_1$, $SQ_2$ is operable by the microprocessor 16. A first diode $D_1$ is connected in parallel with the first selector switch $SQ_1$, and a second diode $D_2$ is connected in parallel with the second selector switch $SQ_2$. A current $I_{DISCHARGE}$ is permitted to flow in a discharge direction through the selected fuel injector 12*a* when its associated selector switch $SQ_1$ is activated and the discharge switch Q2 is operated. The first and second diodes $D_1$, $D_2$ each allow a current $I_{CHARGE}$ to flow in a charge direction during the charging phase of operation of the circuit, across the first and the second fuel injectors 12*a*, 12*b*, respectively.

A regeneration switch circuitry is included in the drive circuit 20*a* in parallel with the injectors 12*a*, 12*b* to implement the regeneration phase. The regeneration switch circuitry serves to connect the second storage capacitor $C_2$ to the inductor $L_1$. The regeneration switch circuitry comprises a regeneration switch RSQ which is operable by the microprocessor 16. A first regeneration switch diode $RSD_1$ is connected in parallel with the regeneration switch RSQ; and a second regeneration switch diode $RSD_2$ is coupled in series to the first regeneration switch diode $RSD_1$ and the regeneration switch RSQ. The second regeneration switch diode $RSD_2$ acts as a protection diode, because the first and second regeneration switch diodes $RSD_1$, $RSD_2$ are opposed to each other, so that current will not flow through the regeneration switch circuitry unless the regeneration switch RSQ is closed and current is flowing from the second voltage rail $V_1$. Current, thus, cannot pass through the regeneration switch circuitry during the charging phase.

The middle current path 32 includes a current sensing and control means 34 that is arranged to communicate with the microprocessor 16. The current sensing and control means 34 is arranged to sense the current in the middle current path 32 and to compare the sensed current with a predetermined current threshold. The current sensing and control means 34 generates an output signal when the sensed current is substantially equal to the predetermined current threshold.

A voltage sensing means (not shown) is also provided to sense the sensed voltage $V_{SENSE}$ across the fuel injector 12*a*, 12*b* selected for injection. The voltage sensing means is used to sense the voltages $V_{C1}$, $V_{C2}$ across the first and second storage capacitors $C_1$, $C_2$, and the power supply 22. The regeneration phase is terminated when sensed voltage levels $V_{C1}$, $V_{C2}$ across the first and second storage capacitors $C_1$, $C_2$ are substantially the same as predetermined voltage levels.

The drive circuit 20*a* also includes control logic 30 for receiving the output of the current sensing and control means 34, the sensed voltage, $V_{SENSE}$, from the positive terminal (+) of the actuators 11 of the fuel injectors 12*a* and 12*b*, and the various output signals from the microprocessor 16 and its memory 24. The control logic 30 includes software executable by the microprocessor 16 for processing the various inputs so as to generate control signals for each of the charge and the discharge switches $Q_1$, $Q_2$, the first and second selector switches $SQ_1$, $SQ_2$, and the regeneration switch RSQ.

During operation of the drive circuit 20*a*, a drive pulse (or voltage waveform) is applied to the piezoelectric actuator 11 of each fuel injector 12*a* and 12*b*, for example the first fuel injector 12*a*. The drive pulse varies between the charging voltage, $V_{CHARGE}$, and the discharging voltage, $V_{DISCHARGE}$. When the first fuel injector 12*a* is in a non-injecting state, prior to an injection event, the drive pulse is at $V_{CHARGE}$ so that a relatively high voltage is applied to the piezoelectric actuator 11. Typically, $V_{CHARGE}$ is around 200 to 300 V. When it is required to initiate an injection event, the drive pulse is reduced to $V_{DISCHARGE}$, which is typically around −100 V. To terminate the injection event, the voltage of the drive pulse is increased to its charging voltage level, $V_{CHARGE}$, again.

In general, in operating a selected fuel injector (e.g. the first fuel injector 12*a*) on an injector set 10, the associated drive circuit 20*a* is operated in the following manner. Firstly, the discharge switch $Q_2$ and the first selector switch $SQ_1$ of the first fuel injector 12*a* are closed. During the discharge phase that follows, the discharge switch $Q_2$ is automatically opened and closed until the voltage across the selected fuel injector 12*a* is reduced to the appropriate voltage discharge level (i.e. $V_{DISCHARGE}$) to initiate an injection event. After a predetermined time during which injection is required, the fuel injector 12*a* is closed by closing the charge switch $Q_1$. The closing of the charge switch $Q_1$ causes a charging current to flow through the first and second fuel injectors 12*a* and 12*b*. During the subsequent charging phase, the charge switch $Q_1$ is continually opened and closed until the appropriate charge voltage level is achieved (i.e. $V_{CHARGE}$). During the regeneration phase, the regeneration switch RSQ is activated, and the discharge switch $Q_2$ is periodically opened and closed under the control of a signal emitted by the microprocessor 16. Operation of the discharge switch $Q_2$ is continued until the energy on the first storage capacitor $C_1$ reaches a predetermined level.

Various modes of operation of the drive circuit 20*a* in the charging and discharge phases, and the regeneration phase, are described in detail in WO 2005/028836A1.

A fault of the drive circuit 20*a* and its associated fuel injectors 12*a*, 12*b* has detectable response characteristics that indicate the nature of the fault, for example whether it is a short circuit or an open circuit fault associated with at least one of the fuel injectors 12*a*, 12*b*. A fault present in the drive circuit 20*a* may affect the performance of the injector arrangement and may be critical, ultimately, to the performance of the engine 8. Although the aforementioned drive circuit 20*a* and its associated injectors 12*a*, 12*b* have already been developed, a suitable diagnostic tool and a suitable diagnostic method to detect these fault response characteristics is unknown until now.

Figure 3:
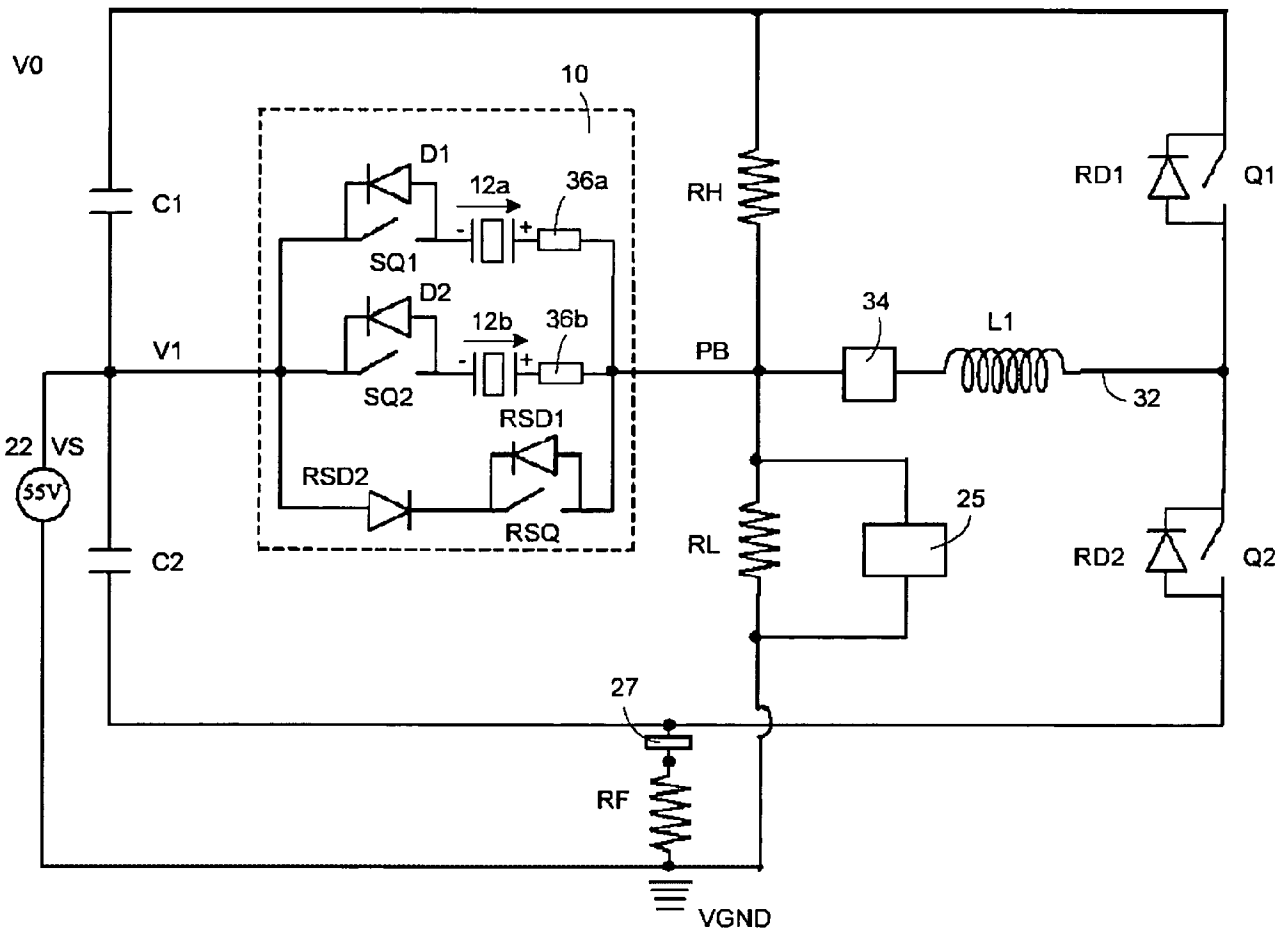
FIG. 3 is a circuit diagram as shown in FIG. 2, further including a first diagnostic tool (an injector sensor circuit), a second diagnostic tool (a resistive bias network) and a third diagnostic tool (a fault trip circuit) according to one embodiment of the present invention.

Referring to FIG. 3, the drive circuit 20*a* of the invention is provided with an integral diagnostic tool. For ease of reference all the features common to FIG. 2 have the same reference numerals in FIG. 3. The diagnostic tool provides a robust diagnostic system that is operated according to specific diagnostic methods to detect critical failure modes of the drive circuit 20*a* and its associated piezoelectric fuel injectors 12*a*, 12*b*. The diagnostic tool thereby prevents complete failure of the drive circuit 20*a* and the fuel injectors 12*a*, 12*b*.

The diagnostic tool includes an injector sensor circuit, a resistive bias network and a fault trip circuit.

The injector sensor circuit comprises a first current sensor 36*a* and a second current sensor 36*b*. The current sensors 36*a*, 36*b* are located within the injector set 10. The first current sensor 36*a* is connected in series with the first fuel injector 12*a*, to the high side of the fuel injector 12*a*, and the second current sensor 36*b* is connected in series with the second fuel injector 12*b*, to the high side of the second fuel injector 12*b*. So, the first and second current sensors 36*a*, 36*b* are in parallel with each other.

The current sensors 36*a*, 36*b* each provide an output to the microprocessor 16 of the ECM 14. The microprocessor 16 is arranged to operate both of the current sensors 36*a*, 36*b* and receives signals from each of the current sensors 36*a*, 36*b* indicative of current flow through the respective fuel injector 12*a*, 12*b*.

The resistive bias network comprises a first resistor $R_H$ and a second resistor $R_L$. The first resistor $R_H$ is connected between the first voltage rail $V_0$ and the high side of the fuel injectors 12*a*, 12*b* at a bias point $P_B$ that is connected to the inductor $L_1$. The second resistor $R_L$ is connected to the high side of the fuel injectors 12*a*, 12*b*, at the bias point $P_B$, and to the ground potential $V_{GND}$. The first and second resistors $R_L$ and $R_H$ each have a known resistance of a high order of magnitude. A volt sensor 25 is connected across the second resistor $R_L$ and provides an output to the microprocessor 16. The microprocessor 16 is arranged to operate the volt sensor 25 and receives signals from the volt sensor 25 indicative of a bias voltage across the second resistor $R_L$.

In the fault trip circuit, a fault trip resistor $R_F$ is located in the connection of the drive circuit 20*a* to the ground potential $V_{GND}$. A current sensor 27 is connected in series with the fault trip resistor $R_F$ in order to sense the current that passes through the fault trip resistor $R_F$. The fault trip resistor $R_F$ is of very low resistance with an order of magnitude of milliohms. The microprocessor 16 is arranged to transmit control signals to the current sensor 27 and receives signals from the current sensor 27 indicative of the current flow through the fault trip resistor $R_F$.

When one of the fuel injectors 12*a*, 12*b* is selected the injector sensor circuit can detect stack terminal short circuit faults associated with the deselected fuel injector 12*a*, 12*b* and open circuit faults associated with the selected fuel injector 12*a*, 12*b*. However the fuel injectors 12*a*, 12*b* can have other types of fault, which can be detected by using the resistive bias network and the fault trip circuit. The fault trip circuit detects high side and low side to ground potential short circuits, and the resistive bias network can detect all types of short circuit fault as well as open circuit faults. In addition different diagnostic tools can detect the same type of fault under different circumstances. So it is advantageous to have the three diagnostic tools in the same drive circuit 20*a*, so that all the different types of fault can be detected, under different working conditions, which would not be possible by using one of the diagnostic tools on its own.

The features of the resistive bias network and fault trip circuit, and methods of their use individually and together, are described in detail in co-pending European patent application number 06251881.6.

The following description is of the injector circuit of the drive circuit 20*a* operating under normal running conditions. Under these conditions, the charges on the piezoelectric actuators 11 of the associated fuel injectors 12*a*, 12*b* are accurately predictable at any point during an injection cycle.

In FIG. 3, all the switches ($Q_1$, $Q_2$, $SQ_1$, $SQ_2$ and RSQ) of the drive circuit 20*a* are shown open, so each of the current sensors 36*a*, 36*b* are in an open circuit. If the piezoelectric actuators 11 of both injectors 12*a*, 12*b* are fully charged, the current sensors 36*a*, 36*b* sense a sensed current $I_{sense}$ that is equal to substantially zero amps (referred to as a 'first threshold current' $I_{limit}$).

Figure 4:
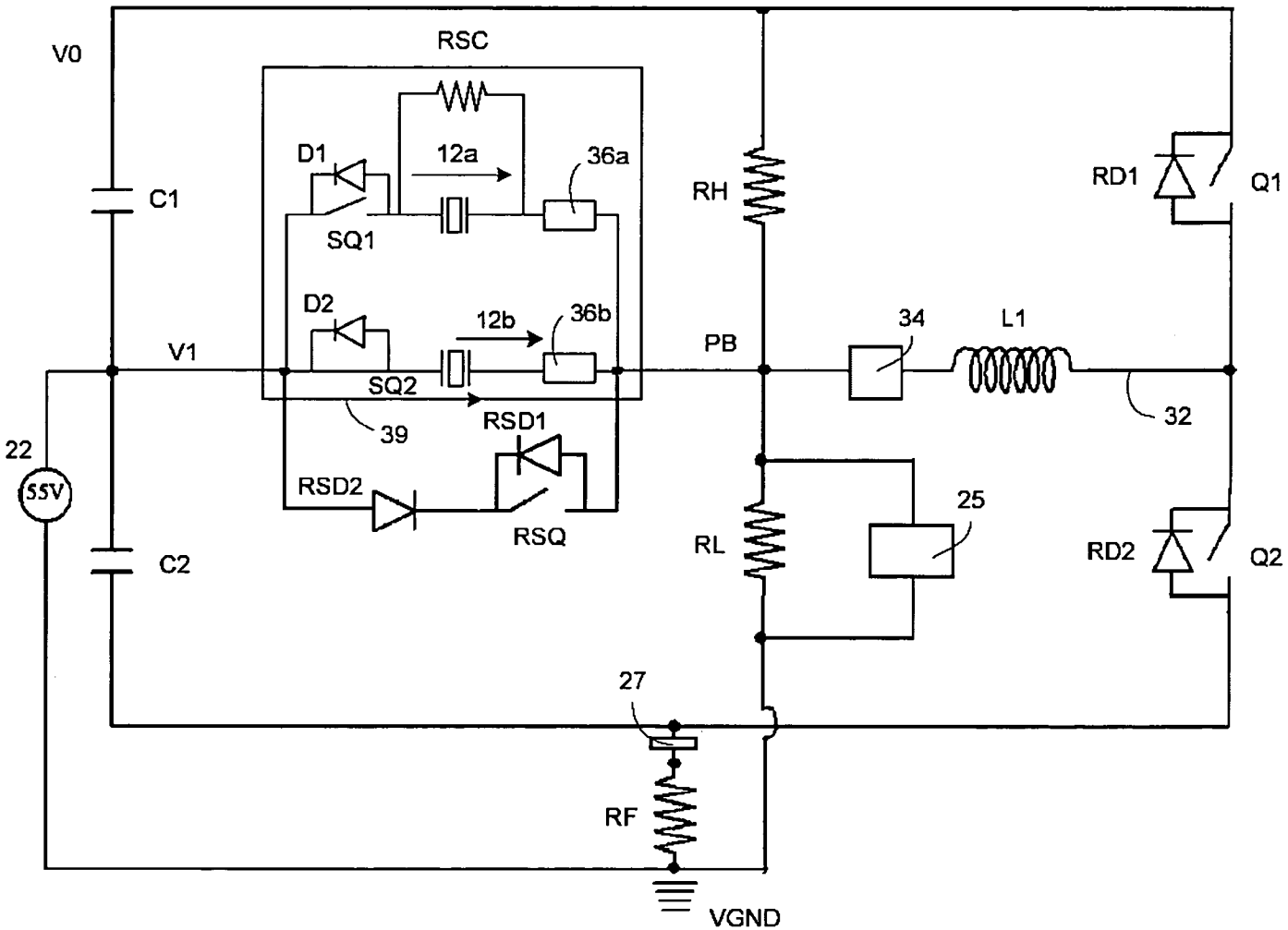
FIG. 4 is the circuit diagram of FIG. 3, configured to detect a stack terminal short circuit fault in a fuel injector using the injector sensor circuit.

Referring to FIG. 4, the deselected first fuel injector 12*a* has a stack terminal short circuit fault. When both fuel injectors 12*a*, 12*b* are fully charged, the first fuel injector 12*a* discharges through its resistive fault element $R_{SC}$. When the second selector switch $SQ_2$ is closed, the potential difference between the first fuel injector 12*a* and the second fuel injector 12*b* causes a current to flow (as shown by an arrow 39) from the second fuel injector 12*b*, through the first and second current sensors 36*a*, 36*b*, through the resistive fault element $R_{SC}$ and the first fuel injector 12*a*, through the first diode $D_1$ and through the second selector switch $SQ_2$. As the second fuel injector 12*b* discharges, the faulty first fuel injector 12*a* therefore recharges. Thus, the sensed current $I_{sense}$ detected by the first current sensor 36*a* is greater than the first threshold current $I_{limit}$. When the sensed current $I_{sense}$ detected by the current sensor 36*a* that is associated with the unselected fuel injector 12*a* exceeds the first threshold current $I_{limit}$, the microprocessor 16 initiates a fault signal. If the first fuel injector 12*a* does not have a stack terminal short circuit (situation not shown), the sensed current $I_{sense}$ would be substantially equal to the first threshold current $I_{limit}$. So, by monitoring the current flowing through the current sensor 36*a* associated with the unselected fuel injector 12*a* to measure $I_{sense}$ it is possible to determine whether or not the unselected fuel injector 12*a* has a stack terminal short circuit fault.

To determine whether the selected second fuel injector 12*b* has a stack terminal short circuit fault, the second injector 12*a* is deselected by opening the second selector switch $SQ_2$ and the first selector switch $SQ_1$ is closed to select the first fuel injector 12*a*. If the second current sensor 36*b* senses a current $I_{sense}$ in excess of the first threshold current $I_{limit}$, this is an indication that the second fuel injector 12*b* has a stack terminal short circuit fault and the microprocessor 16 initiates a fault signal. By selecting each fuel injector 12*a*, 12*b* in turn and by monitoring the current sensors 36*a*, 36*b* that correspond to the deselected fuel injectors of the injector set 10, it is therefore possible to determine whether or not each injector has a stack terminal short circuit fault.

Sometimes a stack terminal fault is so small (i.e. because the resistance of the short circuit fault is so high) that the fuel injector 12*a*, 12*b* with which the fault is associated functions sufficiently well for the fault to be ignored. So, the microprocessor 16 is configured to provide a signal indicative of a fault only if the sensed current $I_{sense}$ exceeds the magnitude of the first threshold current $I_{limit}$ by a tolerance current $I_{stol}$. Typically, the tolerance current $I_{stol}$ is a few milliamps.

When a fuel injector with an open circuit fault is selected in conjunction with actuation of the discharge switch $Q_2$ (situation not shown), it does not conduct current. For example, if the selected fuel injector 12*b* in FIG. 4 has an open circuit fault, the current sensor 36*b* senses an open sensed current $I_{opsense}$ substantially equal to the first threshold current $I_{limit}$. To determine whether the selected fuel injector 12*b* has an open circuit fault, the current sensor 36*b* (that is associated with the selected fuel injector 12*b*) is enabled whilst the second selector switch $SQ_2$ and the discharge switch $Q_2$ are closed.

In testing the deselected fuel injectors 12*a*, 12*b* of the injector set 10 for a stack terminal short circuit fault using the injector sensor circuit, each fuel injector 12*a*, 12*b* is selected in turn. When selected, each fuel injector 12*a*, 12*b* is also tested for an open circuit fault. Firstly, the discharge switch $Q_2$ is actuated a short time after the testing of the unselected fuel injector 12*b* for stack terminal short circuit faults is complete. Then, if the sensed current $I_{sense}$ sensed by the current sensor 36*a* associated with the selected fuel injector 12*a* equals the first threshold current $I_{limit}$, the microprocessor 16 connected to the current sensor 36*b* initiates a signal indicative of an open circuit fault. Thus, the presence of a current sensor 36*a*, 36*b* associated with each fuel injector 12*a*, 12*b* enables detection of an open circuit fault on each fuel injector 12*a*, 12*b*.

A fuel injector 12*a*, 12*b* may conduct very small currents, even when it has an open circuit fault. The microprocessor 16 is therefore configured to provide a signal indicative of an open circuit fault if the sensed current $I_{sense}$ exceeds the magnitude of the first threshold current $I_{limit}$ by no more than an open circuit tolerance current $I_{optol}$. Typically, the tolerance current is a few milliamps.

Figure 5:
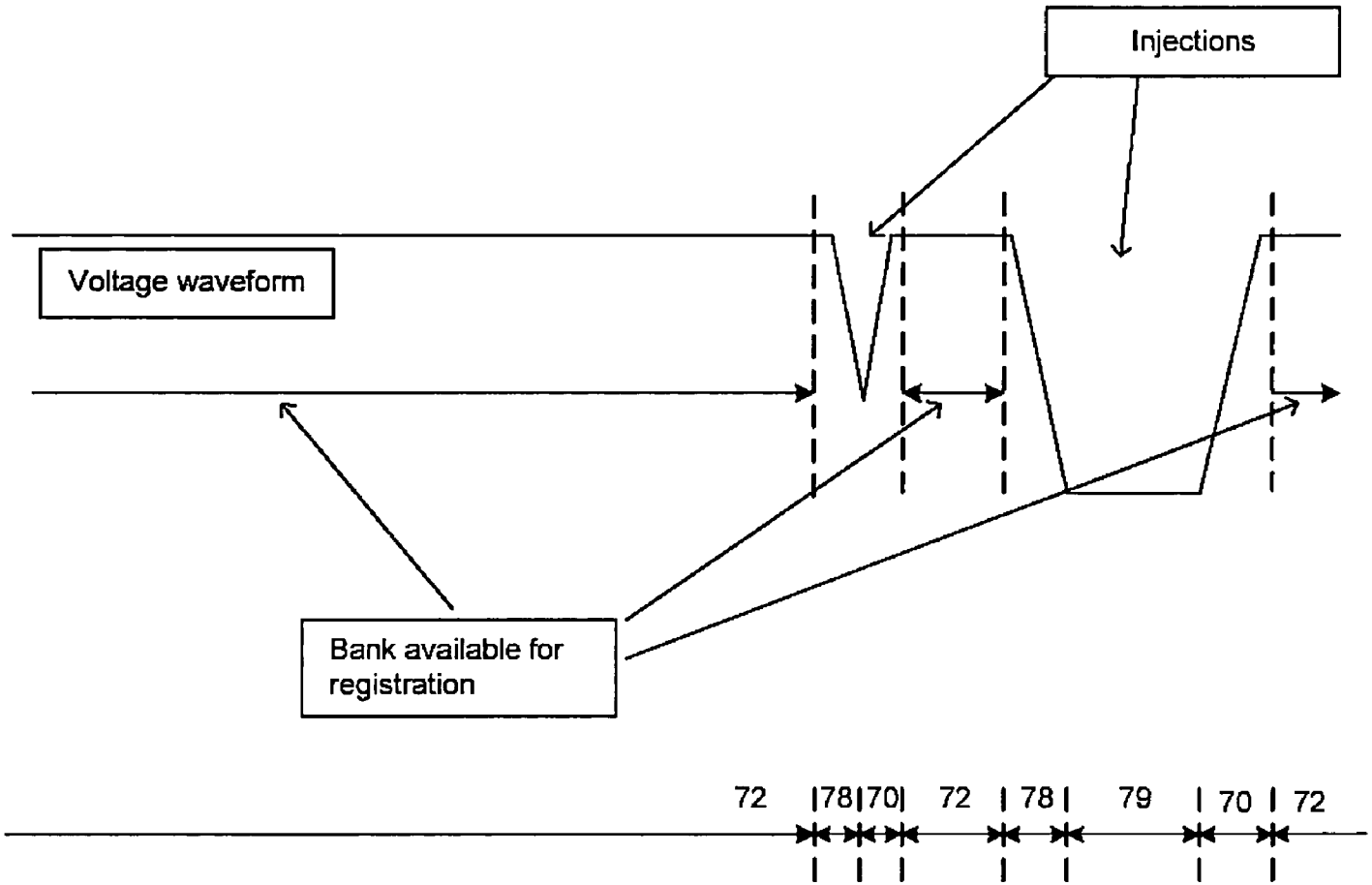
FIG. 5 is a schematic representation of a voltage waveform across a set of injectors illustrating the timing of the use, in an injection cycle, of the injector sensor circuit shown in FIG. 3.

Under normal running conditions, the drive circuit 20*a* and its injector sensor circuit follow an operating method to detect stack terminal short circuit faults. The method, or diagnostic test, is in the form of specific steps carried out during an injection cycle of a selected fuel injector 12*a*, 12*b*, as shown in FIG. 5. Each step of the diagnostic method is carried out over a specific period of the injection cycle. The discharge phase of the selected injector 12*a*, 12*b* is initiated in a first period 78, by reducing the drive pulse (the voltage across the selected fuel injector 12*a*, 12*b*) to the discharge voltage level, $V_{DISCHARGE}$, by operating the discharge switch $Q_2$. An injection event of the selected fuel injector 12*a*, 12*b* occurs during a second period 79. However, the injection event is not limited to the period 79. The injection event starts when the valve needle 13 associated with selected fuel injector 12*a*, 12*b* opens, which is typically towards the end of the first period 78, before the selected fuel injector 12*a*, 12*b* is fully discharged. The injection event terminates once the valve needle 13 associated with the selected fuel injector 12*a*, 12*b* is closed. This occurs towards the beginning of a third period 70, after the start of the charge phase. To begin the charge phase, the drive pulse is increased to the charge voltage level, $V_{CHARGE}$, by operating the charge switch $Q_1$. The injector set 10 then undergoes the regeneration phase in a fourth period 72.

One of the fuel injectors 12*a*, 12*b* is selected before the beginning of the first period 78 and thus before the operation of the discharge switch $Q_2$. In selecting one of the fuel injectors 12*b*, the corresponding second selector switch $SQ_2$ is closed and the other fuel injector 12*a* is deselected by opening the corresponding first selector switch $SQ_1$. Once the selector switches $SQ_1$, $SQ_2$ have been operated, the current sensor 36*a* associated with the deselected (non-injecting) fuel injector 12*a* is enabled to detect a stack terminal short circuit fault associated with the deselected fuel injector 12*a*. A period of time later, the discharge switch $Q_2$ is activated and the current sensor 36*b* associated with selected (injecting) fuel injector 12*b* is enabled to detect an open circuit fault. The current sensors 36*a*, 36*b* are disabled once the injection event of the selected injector 12*b* is complete, towards the beginning of the third period 70. Whichever of the fuel injectors 12*a*, 12*b* was previously deselected is then selected for injection, and vice versa.

The injector sensor circuit monitors the current through the deselected injector 12*a* and the selected fuel injector 12*b* during the injecting sequence of the selected injector 12*b*. As each of the fuel injectors 12*a*, 12*b* is selected and deselected in turn through successive injection cycles, both of the fuel injectors 12*a*, 12*b* are tested for stack terminal short circuit faults and open circuit faults. Consequently, stack terminal short circuit and open circuit faults can be advantageously detected by using the injector sensor circuit in its operating method without having to add additional stages to the injection cycle.

Furthermore, there is no delay in detection of these faults by using the injector sensor circuit, because as soon as the current sensors 36*a*, 36*a* are enabled they are each immediately responsive to the sensed current $I_{sense}$ flowing through the respective fuel injectors 12*a*, 12*b*.

Although, during normal running conditions, the charges on the piezoelectric actuators 11 are generally known, at start up the charges on the piezoelectric actuators 11 are not known. Therefore, it is necessary to test for faults at start up using a different method from that used when the injector set 10 is in operation, so as to ensure the charges on the actuators 11 are known.

So that the charges on the piezoelectric actuators 11 of the fuel injectors 12*a*, 12*b* are known at start up, it is necessary to preset the charges present on the actuators 11. In a preliminary step, the selector switches $SQ_1$, $SQ_2$ are open, the current sensors 36*a*, 36*b* are each enabled to detect an open circuit fault and the associated fuel injectors 12*a*, 12*b* are charged by closing the charge switch $Q_1$. Open circuit fuel injectors can be detected at this point because, on charging, current is expected to flow through both fuel injectors 12*a*, 12*b* and through both of the associated current sensors 36*a*, 36*a*. A current sensor 36*a*, 36*b* that fails to detect current provides an indication that its associated fuel injector 12*a*, 12*b* has an open circuit fault.

In the steps of the diagnostic method that follow, the method at start up is precisely the same as that implemented using the injector sensor circuit whilst the bank is operating under normal running conditions for detecting stack terminal short circuit faults. However, a period of time elapses before the diagnostic test for stack terminal short circuit faults is begun so as to give the unselected fuel injectors 12*a*, 12*b* time to discharge through the resistance of any stack terminal faults that might be present. Furthermore, as open circuit faults present on the injector set 10 would already have been detected, the steps to detect open circuit faults during normal running conditions are omitted.

If testing is completed without detecting a stack terminal short circuit fault or an open circuit fault, activity on the injector set 10 is enabled.

Although the injector sensor circuit is capable of detecting stack terminal short circuit faults, it is not capable of detecting other types of short circuit fault. However, as mentioned previously, the resistive bias network as shown in FIG. 3 can detect three types of short circuit fault associated with a fuel injector: a stack terminal short circuit fault, a short circuit from the low side of the actuator 11 of one the fuel injectors 12*a*, 12*b* to the ground potential $V_{GND}$, and from the high side of the actuator 11 to the ground potential $V_{GND}$.

In using the resistive bias network to detect a short circuit fault, all the switches ($Q_1$, $Q_2$, $SQ_1$, $SQ_2$, and RSQ) of the drive circuit 20*a* are open, as shown in FIG. 3, and the piezoelectric actuators 11 of both injectors 12*a*, 12*b* are fully charged. A short circuit fault associated with any of the fuel injectors 12*a*, 12*b* in the injector set 10 is detected if a measured bias voltage $V_{BIAS}$ at the bias point $P_B$ is not a predetermined bias voltage $V_{Bcalc}$. However, a stack terminal fault and a high side to ground potential short circuit fault with high resistance can have the same measured bias voltage $V_{BIAS}$. The resistive bias network is therefore not capable of distinguishing between these two types of fault. However, the injector sensor circuit specifically detects stack terminal faults of the actuator 11. Therefore, in using the resistive bias network and the injector sensor circuit together it is possible to detect and distinguish a high side to ground short circuit fault from a stack terminal fault. So, it is possible to detect all the different types of short circuit fault present in a fuel injector arrangement with confidence.

Furthermore, in order to diagnose a fuel injector fault, the resistive bias network is dependent on the accurate prediction of the effect of a faulty injector on a bias voltage $V_B$ measured at a bias point $P_B$. In a stack terminal fault the magnitude of the resistance of the resistive element $R_{SC}$ and of the capacitance of the remaining elements of a faulty injector, are unknown. It is therefore difficult to predict accurately an equivalent parallel circuit of the resistive element $R_{SC}$ and the remaining capacitive elements for a fuel injector, and thus the effect of such a faulty fuel injector on the measured bias voltage $V_{BIAS}$. Since the injector sensor circuit is capable of detecting a stack terminal fault reliably, the injector sensor circuit provides a more robust fault detection methodology for this type of short circuit fault than the resistive bias network.

As mentioned previously, the resistive bias network can also detect open circuit faults of a selected one of the fuel injectors 12*a*, 12*b*. To detect open circuits, the respective one of the selector switches $SQ_1$, $SQ_2$ for the selected fuel injector 12*a*, 12*b* is operated. An open circuit fault is detected if the measured bias voltage $V_{BIAS}$ is not equal to substantially a predicted selected injector voltage $V_{PinjN}$.

In order for the resistive bias network to detect open and short circuit faults, one of the selector switches $SQ_1$, $SQ_2$ is operated. However, there is a time delay between the operation of a selector switch $SQ_1$, $SQ_2$ and the taking of a reading. The time delay exists because two readings are taken using the resistive bias network: one reading is taken without selecting one of the fuel injectors 12*a*, 12*b*, and the other reading is taken having selected one of the fuel injectors 12*a*, 12*b*.

In taking the second reading after the first reading, one of the fuel injectors 12*a*, 12*b* (for example the first fuel injector 12*a*) is selected by closing its associated selector switch $SQ_1$. The measured bias voltage $V_{BIAS}$ then increases over a time period to a predicted selected injector voltage $V_{PinjN}$. The predicted selected injector voltage $V_{PinjN}$ is equal to substantially the sum of the voltage of the second voltage rail $V_1$ and the voltage $V_{injN}$ across the selected injector 12*a*. In taking the first reading after the second reading, the fuel injector 12*a* is deselected by opening the associated selector switch $SQ_1$, and the measured bias voltage $V_{BIAS}$ exponentially decays over a time period to a voltage level set by the resistive bias network.

So, each reading has an unavoidable error caused by the exponential decay of the measured bias voltage $V_{BIAS}$ selection, or deselection, one of the fuel injectors 12*a*, 12*b*. This error source can be minimised by allowing a short time period to elapse between taking the two readings. There is a further delay to process the readings. Therefore, making accurate measurements of the measured bias voltage $V_{BIAS}$ to detect open circuit and short circuit faults using the resistive bias network can be time consuming.

Thus, in using the resistive bias network during normal running conditions it is necessary to cease all activity on the injector set 10 in order to allow for the bias voltage $V_{BIAS}$ to settle after operation of a selector switch ($SQ_1$, $SQ_2$). As a consequence, the injection cycle is adapted to have an extra step, a fifth period (not shown) which occurs during the regeneration phase of the fourth period 72. The addition of the fifth period lengthens the duration of the injection cycle, which limits the speed of operation of the drive circuit 20*a*, and restricts the load range that can be applied to the engine 8. To achieve high speeds, the fifth period is cut out of most injection cycles so that it is present periodically, e.g. in every fifth injection cycle. Since the current sensors 36*a*, 36*a* of the injector sensor circuit are each immediately responsive to the sensed current $I_{sense}$ flowing through the respective fuel injectors 12*a*, 12*b*, the injector sensor circuit can be used to diagnose a stack terminal fault or open circuit fault quickly. So for the injector sensor circuit, it is not necessary to alter the injection cycle to have an additional step to detect open circuit faults and stack terminal short circuit faults.

However, to sense for all types of fault associated with the fuel injectors, the methods of operating the resistive bias network and the injector sensor circuit can be combined. During normal running conditions, the operation of these two diagnostic tools is combined in the fifth period. In the fifth period, the injector arrangement is tested for short circuit faults using the resistive bias network, with the selector switches $SQ_1$, $SQ_2$ open. When one of the selector switches $SQ_1$, $SQ_2$ is then closed to select one of the fuel injectors 12*a*, 12*b* the resistive bias network detects open circuit faults associated with the selected fuel injector 12*a*, 12*b*, and the injector sensor circuit is enabled to detect stack terminal short circuit faults associated with the deselected fuel injector. Likewise, at start up, whilst one of the injector selector switches $SQ_1$, $SQ_2$ is closed during operation of the resistive bias network so as to detect open circuit faults, and the injector sensor circuit is operated to detect stack terminal short circuit faults.

As mentioned previously, the fault trip circuit shown in FIG. 3 is capable of detecting a short circuit fault associated with an injector arrangement, that is either a low side, or high side, short circuit fault to the ground potential $V_{GND}$. As the injector sensor circuit is able to detect a stack terminal fault, it is possible to use the fault trip circuit and the injector sensor circuit together to detect the presence of all three forms of short circuit fault in an injector arrangement at start up, and during normal operating conditions.

In the fault trip circuit, the current through the fault trip resistor $R_F$ is monitored by the current sensor 27 that is operable by the microprocessor 16. In use, if a detected current $I_{dect}$ exceeds a predetermined second threshold current $I_{trip}$, the fault trip circuit is arranged to trip, and the microprocessor 16 is arranged to initiate a signal. Different switches ($Q_1$, $Q_2$, $SQ_1$, $SQ_2$, and RSQ) of the drive circuit 20*a* are operated to detect the two different types of short circuit to ground potential faults. As the switches are all operated ($Q_1$, $Q_2$, $SQ_1$, $SQ_2$, and RSQ) in an injection cycle the fault trip circuit is operational during normal running conditions. So, when the drive circuit 20*a* is in operation, the fault trip circuit and the injector sensor circuit can be used together without adding an extra step to the injection cycle. Furthermore, by using these two diagnostic tools together, it is possible to detect short circuits and open circuits present in an injector arrangement.

In summary, the drive circuit 20*a* advantageously may include the injector sensor circuit, the fault trip circuit and the resistive bias network. The three different diagnostic tools may be used independently to detect the different types of circuit fault. However, as can be appreciated from the aforementioned description, the three different diagnostic tools are complementary and can be used in combination to detect different types of fault under different circumstances.

Having described various embodiments of the present invention, it is to be appreciated that the embodiments in question are exemplary only and that variations and modifications, such as will occur to those possessed of the appropriate knowledge and skills, may be made without departure from the scope of the invention as set forth in the appended claims.

The diagnostic methods in which the injector sensor circuit is used are capable of detecting both short and open circuit faults. These methods may be used to detect these two types of fault separately, instead of together as described above. Thus the injector sensor circuit may be adapted to test only for stack terminal short circuit faults or only for open circuit faults.

In one embodiment, the drive circuit 20*a* comprises only the injector sensor circuit of the three different diagnostic tools. In other embodiments, the drive circuit 20*a* includes the injector sensor circuit and either the resistive bias network or the fault trip circuit.

The drive circuit 20*a* herein described is a generic drive circuit. The injector sensor circuit, the resistive bias network and fault trip circuit may each be adapted for use with similar drive circuits, for example, the drive circuits described in WO 2005/028836.

Other types of drive circuit may be used with each of the diagnostic tools. For example, the drive circuit may only have one voltage rail, or it may not have the circuitry that is used in the regeneration phase. The drive means may have only a single charge storage means.

The injector sensor circuit may be implemented in any drive circuit which has an injector set having at least two injectors that are all arranged in parallel, because the injector sensor circuit is integrated into the injector set 10. For example, the injector set 10 may be in a drive circuit having a single charge storage means.

In another embodiment, the second fuel injector 12*b* of the injector set 10 in FIG. 3 may be replaced with a capacitive component. This drive circuit may still allow the fault detection steps for a stack terminal short circuit fault and an open circuit fault, using the injector sensor circuit, to be used for the first fuel injector 12*a*, as described previously. In a variation of this embodiment, the injector set 10 has only one current sensor 36*a* associated with the first fuel injector 12*a*.

In a further variation, there is only one current sensor 36*a* in the injector set 10, being associated with one of the fuel injectors 12*a*, 12*b* (for example the first fuel injector 12*a*). The current sensor 36*a* can detect an open circuit fault associated with the first fuel injector 12*a* when it is selected, and can detect a stack terminal short circuit fault when the first fuel injector 12*a* is unselected. In addition, when the first fuel injector 12*a* is selected, the current sensor 36*a* can detect the presence of a stack terminal short circuit fault associated with the unselected, second fuel injector 12*b*.

In using the injector sensor circuit to test for open circuit faults, the described diagnostic methods may be varied so that the current sensor 36*a*, 36*b* associated with a selected fuel injector 12*a*, 12*b* is enabled to detect open circuit faults when either of the discharge switch $Q_2$ or the charge switch $Q_1$ is actuated.

Positive charge displacement type fuel injectors may be used instead of negative charge displacement type fuel injectors. At start up the charges on the actuators are unknown, so to preset the charges, the piezoelectric actuators may initially be discharged by operating a discharge switch $Q_2$.

In further variations, the fault trip resistor $R_F$ and the current sensor 27 can be in a single current sensing means that provides the same function.

The diagnostic methods that test the drive circuit 20*a* for short circuit faults to the ground potential $V_{GND}$ are also capable of detecting equivalent short circuits to the voltage $V_{BAT}$ of the engine battery.

In another embodiment of the injector sensor circuit, each of the current sensors 36*a*, 36*b* may be connected in series: to the low side of the associated fuel injector 12*a*, 12*b*, or to the low side of the selector switch $SQ_1$, $SQ_2$, instead of to the high side of the associated fuel injector 12*a*, 12*b*. Furthermore, the current sensors may be connected in series between the low side of the associated fuel injector 12*a*, 12*b* and the high side of the associated selector switch $SQ_1$, $SQ_2$.

In a variation of the injection cycle, a series of injection events may be performed on a single fuel injector 12*a*, 12*b* before carrying out an injection event on the other of the fuel injectors 12*a*, 12*b*.

The invention claimed is:

1. A method of detecting faults in a drive circuit for an injector arrangement comprising a first fuel injector and a capacitive component arranged in parallel, the method comprising:

a) selecting the capacitive component into the drive circuit and deselecting the first fuel injector from the drive circuit;

b) sensing a current through the first fuel injector; and c) providing a first signal on detection of a stack terminal short circuit fault associated with the first fuel injector when the sensed current is at variance from a first threshold current.

2. The method of claim 1, wherein the capacitive component is a second fuel injector.

3. The method of claim 2, further comprising:

a) deselecting the second fuel injector and selecting the first fuel injector; and b) sensing the current through the deselected second fuel injector so as to check for a stack terminal short circuit fault associated with the second fuel injector.

4. The method of claim 2, further comprising controlling a charge switch arrangement to operate the connection of one of the first and second fuel injectors to a first charge storage device during a charging phase so as to cause a charge current to flow therethrough, or to a second charge storage device during a discharge phase so as to cause a discharge current to flow therethrough.

5. The method of claim 4, further comprising, when the charge switch arrangement is operated and one of the first and second fuel injectors is selected:

a) sensing an open circuit current through the selected one of the fuel injectors; and b) providing a second signal on detection of an open circuit fault associated with the selected one of the injectors when the open circuit current is substantially the same as the first threshold current.

6. The method of claim 5, wherein the charge switch arrangement comprises a charge switch for operably activating a charging phase, and the method further comprises operating the charge switch prior to detection of an open circuit fault associated with at least one of the fuel injectors.

7. The method of claim 5, wherein the charge switch arrangement comprises a discharge switch for operably activating the discharge phase, and the method further comprises operating the discharge switch prior to detection of an open circuit fault associated with at least one of the fuel injectors.

8. The method of claim 2, comprising:

a) sensing a measured voltage between a bank connection of the first fuel injector to the second fuel injector and a known voltage level, the measured voltage (V.sub-.BIAS) being biased with respect to the known voltage to a predicted voltage unless the drive circuit has a fault; and b) providing a third signal indicative of an open or short circuit fault on sensing of a measured voltage that differs from the predicted voltage.

9. The method of claim 2, comprising:

a) sensing a detected current through a ground connection of the drive circuit to the ground potential; and b) providing a fourth signal indicative of a short circuit fault when the detected current is at variance from a second threshold current.

10. The method of claim 2, wherein selecting each of the first and second fuel injectors into, and deselecting the first and second fuel injectors from, the drive circuit comprises operating a selector switch arrangement.

11. The method of claim 2, wherein the method comprises selecting the first and second fuel injectors in turn.

12. A computer program product comprising at least one computer program software portion which, when executed in an executing environment, is operable to implement one or more of the steps from the set consisting of:

a) selecting the capacitive component into the drive circuit and deselecting the first fuel injector from the drive circuit;

b) sensing a current through the first fuel injector; and c) providing a first signal on detection of a stack terminal short circuit fault associated with the first fuel injector when the sensed current is at variance from a first threshold current.

13. A data storage medium having at least one computer program software portion which, when executed in an executing environment, is operable to implement one or more steps from the set consisting of:

a) selecting the capacitive component into the drive circuit and deselecting the first fuel injector from the drive circuit;

b) sensing a current through the first fuel injector; and c) providing a first signal on detection of a stack terminal short circuit fault associated with the first fuel injector when the sensed current is at variance from a first threshold current.

14. A microcomputer provided with a data storage medium having at least one computer program software portion which, when executed in an executing environment, is operable to implement one or more steps from the set consisting of:

a) selecting the capacitive component into the drive circuit and deselecting the first fuel injector from the drive circuit;

b) sensing a current through the first fuel injector; and c) providing a first signal on detection of a stack terminal short circuit fault associated with the first fuel injector when the sensed current is at variance from a first threshold current.

* * * * *